United States Patent [19]

Hsu et al.

[11] 4,070,256

[45] Jan. 24, 1978

[54] ACID ZINC ELECTROPLATING BATH AND PROCESS

[75] Inventors: Grace F. Hsu, Somers; Jaan-Jiue Fong, Tolland, both of Conn.

[73] Assignee: Minnesota Mining and Manufacturing Company, Saint Paul, Minn.

[21] Appl. No.: 587,147

[22] Filed: June 16, 1975

[51] Int. Cl.[2] ..... C25D 3/22

[52] U.S. Cl. ..... 204/55 R

[58] Field of Search ..... 204/55 R, 43 Z

[56] References Cited

U.S. PATENT DOCUMENTS

| | | | |
|---|---|---|---|
| Re. 27,999 | 4/1974 | Korpiun et al. | 204/55 R |
| 3,642,591 | 2/1972 | Boose et al. | 204/55 R |
| 3,730,855 | 5/1973 | Poor et al. | 204/55 R |
| 3,787,297 | 1/1974 | Beckwith et al. | 204/55 R |
| 3,891,520 | 6/1975 | Todt et al. | 204/55 R |
| 3,909,373 | 9/1975 | Creutz | 204/55 R |
| 3,919,056 | 11/1975 | Habulak | 204/55 R |
| 3,920,528 | 11/1975 | Voss et al. | 204/55 R |
| 3,928,149 | 12/1975 | Steeg | 204/55 R |

*Primary Examiner*—G. L. Kaplan

*Attorney, Agent, or Firm*—Cruzan Alexander; Donald M. Sell; Gerald F. Chernivec

[57] ABSTRACT

An aqueous, ammonium ion-free acid zinc electroplating solution comprising a source of zinc ion, a soluble electrolyte, boric acid, a non-ionic polyoxyalkylated surfactant, and an organic acid, the bath being operable at a pH of about 3.0 to about 6.5. Preferably, the bath also contains a brightener. Spent baths are simply and inexpensively disposed of.

7 Claims, No Drawings

ACID ZINC ELECTROPLATING BATH AND PROCESS

BACKGROUND OF THE INVENTION

In the past, many electroplating baths have been disclosed for providing bright zinc deposits on metallic substrates for use in many industrial applications. Initially, one of the most widely accepted commercial baths utilized a cyanide electrolyte. These cyanide-based baths, while highly effective for electroplating zinc, present significant objectionable features, not the least of which are toxicity and difficulty of waste disposal unless expensive waste treatment equipment is employed.

To overcome many of the objectionable features of cyanide-based baths, sulfate or chloride electrolytes have been proposed; see, e.g., U.S. Pat. Nos. 3,729,394; 3,594,291; 3,694,330 and 3,855,085. In all of these baths, however, ammonium ions and/or chelates are taught to be desirable and/or necessary to provide bright zinc deposits. The presence of ammonium ions and/or chelating complexforming compounds significantly increases the difficulty of eliminating heavy metals from spent baths because of the ability of such compounds to complex with heavy metal ions.

SUMMARY OF THE INVENTION

In accordance with the invention there is provided an acid zinc, ammonium ion-free electroplating bath containing, per liter, from about 4.0 to about 100.0 grams of zinc ion, from about 15.0 to about 250.0 grams of an electrolyte which includes a soluble alkali salt of hydrochloric acid, sulphuric acid, fluoboric acid or mixtures thereof; from about 2.0 to about 40.0 grams of a non-ionic polyoxyalkylated surfactant; from about 0.1 to about 15.0 grams of an organic acid; and at least about 1.0 grams per liter of boric acid. Preferably the bath also contains from about 0.05 to about 2.0 grams of a brightener.

The bath can be effectively operated at a pH of from about 3.0 to about 6.5 at temperatures ranging from about 15° C. to 45° C. A potential can be applied across the anode and the metallic work piece to provide a current density of about 0.01 to about 12.0 amperes per square decimeter at the metallic surface so as to deposit zinc thereon.

The present bath is free of the interferring ammonium ions and chelating agents and yet has high cathode current efficiency, produces bright, smooth, fine-grained zinc deposits over a wide range of plating conditions and cathode current density upon continued electrolysis. The bath further exhibits excellent bright throwing power in recessed areas of the cathode and displays highly satisfactory leveling action of the zinc deposit. Because ammonium ions and chelating agents are not present, simplified and correspondingly less expensive waste treatment procedures for heavy metal removal can be utilized.

DETAILED DESCRIPTION OF THE PREFERRED EMBODIMENTS

The bath may be formulated from various soluble zinc salts or alternatively from zinc oxide, the latter being capable of forming a zinc salt in combination with the anions normally otherwise introduced. Typical soluble zinc salts include zinc chloride, zinc sulfate, zinc fluoborate or mixtures thereof. The concentration of zinc salt should be sufficient to provide from about 4.0 to about 100.0 grams of zinc ion per liter, about 20.0 to about 80.0 grams per liter being preferred.

Below about 4.0 grams of zinc ion per liter the current efficiency of the bath is reduced, and the upper current density is limited to about 5.0 amperes per square decimeter, above which burning of the cathode may be noted. Zinc ion concentrations of greater than about 100 grams per liter are economically wasteful, since minimal increase in bath characteristics will be provided and solubility problems may be encountered due to a common ion effect.

In order to impart satisfactory conductivity, the bath includes an electrolyte, typically obtained from soluble alkali salts of hydrochloric acid, sulfuric acid, fluoboric acid or mixtures thereof. The most common and preferred alkali salts are those of potassium or sodium. The anion electrolyte concentration should be about 15 to about 250 grams per liter, with from about 75 to about 200 being preferred. In the past it has been taught to be necessary to include an ammonium salt as one of the electrolyte components in order to obtain commercially usable formulations. However, with the composition of the present bath, ammonium is not necessary to the proper functioning thereof to provide a bright zinc deposit on a metallic substrate.

At low electrolyte concentration, i.e., below 15 grams per liter, the bath has such low conductivity that reduced coverage of the cathode results. Concentrations greater than about 250 grams per liter provide minimal gain in bath operation for the additional expense incurred and furthermore may result in solubility limits being exceeded such that precipitation may occur in the bath.

A wide variety of non-ionic polyoxyalkylated surfactants may be used in the bath such as, for example, alkoxylated:alkyl phenols, e.g. nonylphenol; alkyl napthols; aliphatic monohydric alcohols; aliphatic polyhydric alcohols, e.g. polyoxypropylene glycol and 2,4,7,9-tetramethyl-5-decyne-4,7-diol; ethylene diamine; fatty acids, fatty amids, e.g. amide of coconut fatty acid; or esters, e.g. sorbitan monopalmitate. Exemplary alkoxylated compounds within the above classes which are commercially available include "Neutronyx" 640, tradename for an ethoxylated nonyl phenol, available from the Millmaster Onyx Corp.; "Igepal" CA 630, tradename for an ethoxylated octyl phenol, available from the GAF Corp.; "Renex" 650, tradename for an ethoxylated nonyl phenol alcohol available from ICI America, Inc.; "Brij" 98, tradename for an ethoxylated oleyl alcohol available from ICI America, Inc.; "Pluronic" L64 and "Pluronic" F68, tradename for a polyoxyethylenepolyoxypropylene glycol available from BASF Wyandotte Corp.; "Surfynol" 485, tradename for ethoxylated 2,4,7,9-tetramethyl-5-decyne-4,7-diol available from Air Products and Chemicals, Inc.; "Tetronic" 504, tradename for an ethoxylated propoxylated ethylene diamine available from BASF Wyandotte Corp.; "Myrj" 52S, tradename for an ethoxylated stearic acid available from ICI America, Inc.; "Amidox" C-5, tradename for a polyethoxylated coconut acid monoethanolamide available from Stepan Chemical Co.; and "Tween" 40, tradename for an ethoxylated sorbitan palmitate available from ICI America, Inc.

The concentration on non-ionic polyoxyalkylated surfactant in the bath should be from about 2.0 to about 40.0 grams per liter, with from about 4.0 to about 20.0 grams per liter being preferred. At lower concentrations, i.e., below about 2.0 grams per liter, the zinc deposit is dark and coarse with no apparent grain refinement. Concentrations greater than about 40.0 grams per liter provide no additional benefit to the functioning of the bath and may exceed solubility limits therein.

Minor amounts on anionic surfactants, e.g. "Triton" QS-15 available from Rohm and Haas Co. and "Loman" NCO available from Diamond Shamrock Chemical Co., may be utilized in conjunction with the non-ionic polyoxylakylated surfactants.

Numerous organic acids are available for use in conjunction with the aforementioned non-ionic polyoxylaklated surfactants. Generally, organic acids having at least 5 carbon atoms are useful herein. Exemplary acids include aryl olefinic acids, aromatic acids, heterocyclic acids, cyclic acids and fatty acids.

Because of the lack of solubility of fatty acids in an aqueous solution, a solubilizer therefor can be conveniently included. Typical solubilizers include diethanolamine and P&G "Amide" 72, tradename for a coconut fatty acid diethanolamine containing therein free amine as diethanolamine, available from the Procter & Gamble Co.

Typical acids within these classes include benzoic acid; cinnamic acid; nonyl phenoxy acetic acid; nicotinic acid; naphthenic acid; "Active" 2, tradename for a coconut oil fatty acid-based compound available from Blew Chemical Company; N-(alkyl sulfonyl) glycine sodium salt; valeric acid in conjunction with "Amide" 72, heptanoic acid (with "Amide" 72 as a solubilizer); octanoic acid, when utilized with, for example, "Duponol" SN, tradename for a mixture of sodium salts of long chain alcohol sulfate available from the E.I. DuPont Co., as a solubilizer; 2-ethyl-hexanoic acid, with "Amide" 72 as a solubilizer; and "Ethofat" 0/20, tradename for an ethoxylated oleic acid available from the Armak Co., when utilized with "Amide" 72 as a solubilizer.

The organic acid should be present in the bath at a concentration of from about 0.1 to about 15.0 grams per liter, with from about 0.2 to about 5.0 grams per liter being preferred. At a concentration below about 0.1 gram per liter a black band is visible on the zinc deposit when operating at low current densities. Additionally, at bath temperatures exceeding about 30° C. this black band is again visible at an acid concentration of less than about 0.1 gram per liter. At concentrations exceeding about 15.0 grams per liter, solubility problems may occur.

A number of brighteners are available for utilization in combination with the surfactant and organic acid to provide bright, specular deposits over the entire useful cathode current density range. Such brighteners include aryl ketones, aryl aldehydes, ring-halogenated aryl ketones and aldehydes, heterocyclic aldehydes and ketones, aryl olefinic ketones and aldehydes, aryl olefinic lactone, and carbocyclic olefinic ketones and aldehydes. Specific examples of brighteners include orthochlorobenzaldehyde, benzylidine acetone, thiophene aldehyde, cinnamic aldehyde, beta-ionone and coumarin. Preferred brighteners include orthochlorobenzaldehyde and benzylidine acetone. When utilized, the brighteners may be employed with the range of about 0.05 to about 2.0 grams per liter with from about 0.075 to about 1.0 gram per liter being preferred. At increasing concentrations, i.e., greater than about 2.0 grams per liter, skip plating may occur at low current densities. Below 0.05 gram per liter, the brightener does not appreciably affect the brightness of the zinc deposit.

In addition to the aforementioned components, it has been found that inclusion of boric acid in the bath extends the limiting cathode current density thereof. Therefore, the bath should include from about 1.0 gram per liter up to saturation of boric acid or a soluble salt thereof.

Soluble acetate salts have been found to assist in obtaining a smooth deposit on the cathode, especially when brighteners are not utilized.

The bath of the present invention can be effectively operated over a pH range of from about 3.0 to about 6.5 with from about 4.5 to about 6.0 being preferred. At a highly acidic pH, i.e., below about 3.0, the rate of chemical attack on the anode increases significantly and bath efficiency is reduced. At a pH of greater than 6.5, there may be a tendency to precipitate hydroxy salts from the bath, adhesion of the zinc deposit on the cathode is relatively poor, and some burning may be noted.

A bath operating temperature range of from about 15° C. to about 45° C. has been found to be satisfactory. Decreased temperatures tend to reduce the efficiency of the bath and may approach the solubility limits of bath components. Increased temperatures may cause a hazy deposit on the cathode and also may exceed the cloud point of bath components, particularly the polyoxyalkalated surfactants.

The invention will now be further illustrated by the following non-limiting specific examples of electroplating solutions of this invention wherein all parts are by weight unless otherwise indicated.

In all of the baths of the following examples, testing was undertaken utilizing a conventional 267-milliliter Hull cell under 3 amperes of current for 3 minutes. The bath was not agitated and temperatures were maintained at 22° C. to 24° C. unless otherwise specified. Adjustments to pH were made by utilizing an appropriate acid or ammonia-free hydroxide.

EXAMPLE 1

An aqueous electroplating bath was prepared containing, per liter, 71 grams of zinc chloride, 225 grams of potassium chloride, 9 grams of "Renex" 650, 0.75 gram of "Igepal" CA630, 34 grams of boric acid, 1.5 grams of benzoic acid and 0.125 gram of orthochlorobenzaldehyde. The pH was adjusted and maintained at 5.6

The zinc deposited on the cathode was fully bright over a current density range of from 0.01 to 12.0 amperes per square decimeter. At densities greater than 12.0 amperes per square decimeter, the deposit was light gray in color.

EXAMPLE 2

To illustrate the effect of boric acid on the bath, a bath was prepared as per Example 1 with the exception that the "Igepal" CA630 and boric acid were omitted. The pH was again maintained at 5.6.

At cathode current density ranges from 0.01 to 3.6 amperes per square decimeter, the deposit was fully bright. From 3.6 to 9.0 amperes per square decimeter, the deposit was bright with some striation or streaking noted. At current densities above 9.0 amperes per square decimeter, the deposit was black with gray sponge material thereon.

EXAMPLE 3

To illustrate the effectiveness of the bath without a brightener, an aqueous electroplating bath was prepared containing, per liter, 71 grams of zinc chloride, 225 grams of potassium chloride, 34 grams of boric acid and 9 grams of "Renex" 650, the bath having a pH maintained at 5.6

At a current density range of from 0 to 0.2 ampere per square decimeter, the zinc deposit was gray in color; from 0.2 to 0.3 ampere per square decimeter, the deposit was semi-bright; from 0.3 to 0.9 ampere per square decimeter, a black band was visible on the deposit; from 0.9 to 1.8 amperes per square decimeter, the band turned from black to gray; from 1.8 to 12.0 amperes per square decimeter, the deposit was semi-bright, smooth, and fine grained; above 12.0 amperes per square foot, burning was noted on the sample.

When boric acid was deleted from the bath, the limiting usable current density was reduced to 4.0 amperes per square decimeter.

EXAMPLE 4

An aqueous electroplating bath was prepared as per Example 3 with the exception that 1.5 grams per liter of benzoic acid was added thereto. The pH again was adjusted to 5.6. At a cathode current density range of from 0 to 1.2 amperes per square decimeter, the deposit was fully bright; from 1.2 to 12.0 amperes per square decimeter the deposit was semi bright and above 12.0 amperes per square decimeter, buring of the deposit was noted.

EXAMPLE 5

An electroplating bath was prepared containing, per liter, 71 grams of zinc chloride, 178 grams of sodium chloride, 34 grams of boric acid, 5.6 grams of "Pluronic" F-68, 1.5 grams of benzoic acid and 0.125 gram of orthochlorobenzaldehyde, the pH of the bath being maintained at 5.6. The zinc deposit was fully bright over a current density range of from 0.01 to 12.0 amperes per square decimeter with some pitting of the deposit noted at current densities greater than 6.0 amperes per square decimeter.

EXAMPLE 6

An electroplating bath was prepared containing 71 grams per liter of zinc chloride, 225 grams per liter of potassium chloride, 34 grams per liter of boric acid, 7.5 grams per liter of "Surfynol" 485, 1.5 grams per liter of benzoic acid, and 0.125 grams per liter of orthochlorobenzaldehyde. The pH of the bath was maintained at 5.4. A fullybright zinc deposit was obtained from current densities ranging from 0.01 to greater than 15.0 amperes per square decimeter.

EXAMPLE 7

An electroplating bath was prepared containing, per liter, 71 grams of zinc chloride, 225 grams of potassium chloride, 34 grams of boric acid, 9 grams of "Renex" 650, 0.27 gram of octanoic acid, 0.8 gram of "Amide" 72, and 0.125 gram of orthochlorobenzaldehyde, the pH of the bath being maintained at 5.4. A fully-bright zinc deposit was obtained over a current density range of from 0.01 to 8.0 amperes per square decimeter. Above 80 amperes per square decimeter, the deposit was rather black with a white powder thereon.

EXAMPLE 8

An electroplating bath was prepared containing, per liter, 71 grams of zinc chloride, 225 grams of potassium chloride, 34 grams of boric acid, 9 grams of "Renex" 650, 3 grams of "Ethofat" 0/20, 0.75 gram of "Amide" 72, and 0.125 gram of orthochlorobenzaldehyde, the pH of the bath being maintained at 5.4. A fully bright deposit was obtained over a current density range of from 0.01 to 12.0 amperes per square decimeter.

EXAMPLE 9

An electroplating bath was prepared containing, per liter, 71 grams of zinc chloride, 225 grams of potassium chloride, 34 grams of boric acid, 9 grams of "Renex" 650, 1.5 grams of benzoic acid and 0.2 gram of thiophene aldehyde, the bath pH being maintained at 5.6.

Over a current density range of from 0 to 1.5 amperes per square decimeter, the zinc deposit was bright with a slight haze thereon and from 1.5 to 12.0 amperes per square decimeter, the zinc deposit was fully bright.

EXAMPLE 10

An electroplating bath was prepared containing, per liter, 125 grams of zinc chloride, 225 grams of potassium chloride, 34 grams of boric acid, 10 grams of isononyl alcohol with 15 moles of ethylene oxide, 1.5 grams of benzoic acid and 0.5 gram of benzylidine acetone, the pH of the bath being maintained at 3.6. A fully-bright zinc deposit was obtained on the cathode panel over a current density range of from 0.1 to 12.0 amperes per square decimeter.

EXAMPLE 11

An electroplating bath was prepared containing, per liter, 71 grams of zinc chloride, 225 grams of potassium chloride, 34 grams of boric acid, 2.3 grams of "Renex" 650, 2.5 grams of "Triton" QS-15, 1.5 grams of benzoic acid and 0.125 grams of orthochlorobenzaldehyde, the pH of the bath being maintained at 5.3. Over a current density range of 0.01 to 7.0 amperes per square decimeter, the zinc deposit was fully bright, and from 7.0 to 12.0 amperes per square decimeter, the zinc deposit was bright with some striation or streaking noted.

EXAMPLE 12

An electroplating bath was prepared containing, per liter, 93 grams of zinc sulfate monohydrate, 150 grams of potassium chloride, 34 grams of boric acid, 9 grams of "Renex" 650, 1.5 grams of benzoic acid, and 0.125 grams of orthochlorobenzaldehyde, the pH of the bath being maintained at 5.1. At cathode current densities of from 0.01 to 4.5 amperes per square decimeter, the zinc deposit was fully bright whereupon between 4.5 and 12.0 amperes per square decimeter, the deposit was somewhat gray. At current densities greater than 12.0 amperes per square decimeter, burning of the deposit was noted.

EXAMPLE 13

An electroplating bath was prepared containing, per liter, 71 grams of zinc chloride, 56 grams of zinc oxide, 225 milliliters of a 49 percent aqueous fluoboric acid, 9 grams of "Renex" 650, 1.5 grams of benzoic acid and 0.2 gram of orthochlorobenzaldehyde, the pH of the bath being maintained at 3.1. At current densities of from 0.01 to 0.3 amperes per square decimeter, the deposit was bright with a slight haze thereon and from 0.3 to 15.0 amperes per square decimeter, the zinc deposit was fully bright.

EXAMPLE 14

An electroplating bath was prepared containing, per liter, 71 grams of zinc chloride, 225 grams of potassium chloride, 34 grams of boric acid, 9 grams of "Renex" 650, 0.75 gram of "Igepal" CA630, 1.5 grams of benzoic acid and 0.125 gram of orthochlorobenzaldehyde, the pH of the bath being maintained at 5.8. The temperature of the bath in this instance was maintained at 100° F. to illustrate the effect of temperature in comparison with Example 1. At current densities of from 0.01 to 7.0, the zinc deposit was fully bright whereupon between 7.0 and 15.0 amperes per square decimeter the deposit had a grayish haze to it.

EXAMPLE 15

An electroplating bath was prepared containing, per liter, 71 grams of zinc chloride, 225 grams of potassium chloride, 34 grams of boric acid, 9 grams of "Renex" 650, 3 grams of N-alkyl sulphonyl glycine sodium salt, and 0.125 gram of orthochlorobenzaldehyde, the pH of the bath being adjusted to 5.8. The zinc deposit was fully bright over a current density range of from 0.01 to 12.0 amperes per square decimeter.

EXAMPLE 16

An electroplating bath was prepared containing, per liter, 71 grams of zinc chloride, 225 grams of potassium chloride, 6 grams of "Pluronic" F68, 2 grams of benzoic acid, and 0.24 gram of benzylidine acetone, the bath having a pH of 5.5. The Hull Cell test panel indicated that from 0.01 to 2.4 amperes per square decimeter the zinc deposit was fully bright with rough plate found above a current density of 1.2 amperes per square decimeter. From 2.4 to 6.0 amperes per square decimeter the deposit was black and spongy.

To indicate the effect of boric acid, 34 grams per liter thereof were added to the bath whereupon the Hull Cell test panel indicated that current densities of from 0.01 to 5.0 amperes per square decimeter provided zinc deposit which was fully bright and from 5.0 to 12.0 amperes per square decimeter the deposit was bright with some striation noted.

EXAMPLE 17

An electroplating solution was prepared containing, per liter, 125 grams of zinc chloride, 35 grams of potassium chloride, 10 grams of isononyl alcohol with 15 moles of ethylene oxide, and 0.5 gram of benzylidine acetone, the pH of the bath being adjusted to 5.4. With this formulation, The Hull Cell test panel indicated that from 0.01 to 0.3 ampere per square decimeter a thin plating was formed, from 0.3 to 1.8 amperes per square decimeter the deposit was black, from 1.8 to 2.4 amperes per square decimeter the deposit was fully bright, from 2.4 to 9.0 amperes per square decimeter the deposit was dull gray and was relatively rough, and above 9.0 amperes per square decimeter the deposit was black and powdery.

To this solution was added 1.5 grams per liter of benzoic acid, whereupon the Hull Cell test panel indicated that from 0.01 to 0.15 ampere per square decimeter a relatively thin plating was formed, from 0.15 to 0.9 ampere per square decimeter a bright plating was obtained, from 0.9 to 2.0 amperes per square decimeter a relatively dull plate was obtained, from 2.0 to 3.0 amperes per square decimeter a bright plate was obtained, and from 3.0 to 12.0 amperes per square decimeter the deposit was fully gray and rather rough.

When 34 grams per liter of boric acid were added to the solution, the Hull Cell test panel indicated a fully bright zinc deposit from 0.01 to 12.0 ampere per square decimeter.

EXAMPLE 18

An electroplating bath was prepared containing, per liter, 150 grams of zinc chloride, 80 grams of sodium chloride, 22 grams of boric acid, 7.5 grams of "Tetronic" 504, 1.5 grams of benzoic acid, 1.0 gram of nicotinic acid, 1.5 grams of "Loman" NCO, and 0.3 gram of orthochlorobenzaldehyde, the pH of the bath being maintained at 4.5. At current densities of from 0.01 to 0.5 amperes per square decimeter, the zinc deposit was bright with a slight haze, and from 0.5 to 12.0 amperes per square decimeter the deposit was fully bright.

EXAMPLE 19

An electroplating bath was prepared containing, per liter, 100 grams of zinc chloride, 150 grams of potassium chloride, 22 grams of boric acid, 7.5 grams of "Tetronic" 504, 1.5 grams of "Lomar" NCO, 1.5 grams of cinnamic acid, and 0.3 grams of orthochlorobenzaldehyde, the pH being maintained at 5.6. At current densities of from 0.01 to 7.5 amperes per square decimeter, the zinc deposit was fully bright. At densities greater than 7.5 amperes per square decimeter, the deposit was dull.

What is claimed is:

1. An aqueous ammonium ion-free electroplating bath for depositing zinc comprising about 4.0 to about 100.0 grams per liter of zinc ion, from about 15.0 to about 250.0 grams per liter of an ammoniumfree electrolyte, from about 2.0 to about 40.0 grams per liter of a non-ionic polyoxyalkylated compound selected from the group consisting of alkoxylated alkyl phenols, alkoxylated alkyl naphthols, alkoxylated aliphatic monohydric alcohols, alkoxylated polyoxypropylene glycols, alkoxylated 2,4,7,9-tetramethyl-5-decyne-4,7-diol, alkoxylated ethylene diamine, alkoxylated fatty acids, alkoxylated amides, and alkoxylated esters, from about 0.1 to about 15.0 grams per liter of a carboxylic acid, and at least about 1.0 grams per liter of boric acid or a soluble salt thereof, the pH of said bath being from about 3.0 to about 6.5.

2. The bath of claim 1 additionally containing from about 0.05 to about 2.0 grams per liter of at least one organic brightening compound.

3. The bath of claim 2 wherein said organic brightening compound is selected from the group consisting of aryl ketones, aryl aldehydes, heterocyclic aldehydes, heterocyclic ketones, aryl olefinic ketones, aryl olefinic aldehydes, aryl olefinic lactone, carbocyclic olefinic ketones and carbocyclic olefinic aldehydes.

4. The bath of claim 1 wherein said electrolyte is selected from the group consisting of soluble alkali salts of hydrochloric acid, sulfuric acid, fluoboric acid, or mixtures thereof.

5. The bath of claim 1 wherein said carboxylic acid is selected from the group consisting of aryl olefinic acids, aromatic acids, heterocyclic acids and solubilizable fatty acids.

6. A method for electroplating zinc comprising the steps of:

a. preparing an ammonium ion-free aqueous bath comprising about 4.0 to about 100.0 grams per liter of zinc ion, from about 2.0 to about 40.0 grams per liter of a non-ionic polyoxyalkylated compound selected from the group consisting of alkoxylated alkyl phenols, alkoxylated alkyl naphthols, alkoxylated aliphatic monohydric alcohols, alkoxylated polyoxypropylene glycols, alkoxylated 2,4,7,9-tetramethyl-5-decyne-4,7-diol, alkoxylated ethylene diamine, alkoxylated fatty acids, alkoxylated amides and alkoxylated esters, from about 0.1 to about 15.0 grams per liter of a carboxylic acid, and at least about 1.0 gram per liter of boric acid or a soluble salt thereof;

b. maintaining said bath at a temperature of from about 15° C to about 45° C and a pH of from about 3.0 to about 6.5;

c. immersing a work piece having a metallic surface and a zinc anode in said bath; and d. applying a voltage across said work piece and anode to thereby cause deposition of zinc on said metallic surface.

7. The bath of claim 6 additionally containing from about 0.05 to about 2.0 grams per liter of an organic brightening compound.

* * * * *

UNITED STATES PATENT AND TRADEMARK OFFICE

CERTIFICATE OF CORRECTION

PATENT NO. : 4,070,256

DATED : January 24, 1978

INVENTOR(S) : Grace F. Hsu and Jaan-Jiue Fong

It is certified that error appears in the above-identified patent and that said Letters Patent are hereby corrected as shown below:

Column 9, line 3, after "of zinc ion," insert -- from about 15.0 to about 250.0 grams per liter of an ammonium ion-free electrolyte, --.

Signed and Sealed this

*Thirteenth* Day of *June 1978*

[SEAL]

*Attest:*

RUTH C. MASON
*Attesting Officer*

DONALD W. BANNER
*Commissioner of Patents and Trademarks*

REEXAMINATION CERTIFICATE (55th)

United States Patent [19]

Hsu et al.

[11] B1 4,070,256

[45] Certificate Issued Mar. 1, 1983

[54] ACID ZINC ELECTROPLATING BATH AND PROCESS

[75] Inventor: Grace F. Hsu, Somers; Jaan-Jiue Fong, Tolland, both of Conn.

[73] Assignee: Minnesota Mining and Manufacturing Company, Saint Paul, Minn.

Reexamination Request

No. 90/000,126, Dec. 18, 1981

Reexamination Certificate for:

| | |
|---|---|
| Patent No.: | **4,070,256** |
| Issued: | **Jan. 24, 1978** |
| Appl. No.: | **587,147** |
| Filed: | **Jun. 16, 1975** |

Certificate of Correction issued Jun. 13, 1978.

[51] Int. Cl.[3] ..... C25D 3/22
[52] U.S. Cl. ..... 204/55 R
[58] Field of Search ..... 204/55 R, 43 Z

[56] References Cited

U.S. PATENT DOCUMENTS

| | | | |
|---|---|---|---|
| Re. 27,999 | 4/1974 | Kurpiun et al. | 204/55 R |
| 2,893,934 | 7/1959 | Westbrook | 204/50 R |
| 3,017,333 | 1/1962 | Waite et al. | 204/49 R |
| 3,079,416 | 2/1963 | Dupre et al. | 260/458 |
| 3,117,999 | 1/1964 | Boettner et al. | 260/584 |
| 3,145,180 | 8/1964 | Dupre et al. | 252/137 |
| 3,245,886 | 4/1966 | Michael | 204/45 R |
| 3,257,294 | 6/1966 | Michael | 204/45 R |
| 3,361,652 | 1/1968 | Korpiun et al. | 204/54 R |
| 3,537,959 | 11/1970 | Korpiun et al. | 204/55 R |
| 3,594,291 | 7/1971 | Todt et al. | 204/55 R |
| 3,616,306 | 10/1971 | Conoby et al. | 204/54 R |
| 3,669,854 | 6/1972 | Harbulak | 204/55 R |
| 3,694,330 | 9/1972 | Korpiun et al. | 204/55 R |
| 3,729,394 | 4/1973 | Hsu et al. | 204/55 R |
| 3,730,855 | 5/1973 | Poor et al. | 204/55 R |
| 3,767,539 | 10/1973 | Caluss et al. | 204/52 R |
| 3,769,182 | 10/1973 | Beckwith et al. | 204/43 S |
| 3,773,630 | 11/1973 | Popescu | 204/55 R |
| 3,778,359 | 12/1973 | Popescu | 204/55 R |
| 3,787,297 | 1/1974 | Beckwith et al. | 204/55 R |
| 3,855,085 | 12/1974 | Rushmere | 204/55 R |
| 3,878,069 | 4/1975 | Todt et al. | 204/55 R |
| 3,891,520 | 6/1975 | Todt et al. | 204/55 R |
| 3,909,373 | 9/1975 | Creutz | 204/55 R |
| 3,909,374 | 9/1975 | Skimin | 204/55 R |
| 3,920,528 | 11/1975 | Voss et al. | 204/55 R |
| 3,928,149 | 12/1975 | Steeg | 204/55 R |
| 3,960,677 | 6/1976 | Hildering et al. | 204/55 R |
| 3,972,788 | 8/1976 | Passal | 204/55 R |
| 3,998,707 | 12/1976 | Fong | 204/50 R |
| 4,014,761 | 3,1977 | Passal | 204/55 R |
| 4,045,305 | 8/1977 | Fong et al. | 204/50 R |
| 4,049,510 | 9/1977 | Rosenberg | 204/55 R |
| 4,075,066 | 2/1978 | Eckles et al. | 204/50 R |
| 4,089,755 | 5/1978 | Steinecker | 204/55 R |
| 4,093,523 | 6/1978 | Henricks et al. | 204/55 R |

FOREIGN PATENT DOCUMENTS

| | | |
|---|---|---|
| 2264010 | 6/1974 | Fed. Rep. of Germany. |
| 2104857 | 4/1972 | France. |
| 602591 | 5/1948 | United Kingdom. |
| 1309946 | 3/1973 | United Kingdom. |
| 1363901 | 8/1974 | United Kingdom. |
| 1453970 | 10/1976 | United Kingdom. |
| 1462725 | 1/1977 | United Kingdom. |

OTHER PUBLICATIONS

McCutcheon's, "Detergents and Emulsifiers", pp. 32, 91, 92, 93, 126, 137, 138, 143, 144 & 197, (1974).

Frederick Lowenheim, "Modern Electroplating", pp. 442–453, 458 & 459, (1974).

Bernard Gaida, "Electroplating Science", pp. 191, 192 & 193, (1970).

Milton J. Rosen, "Surfactants & Interfacial Phenomena", p. 16, (1978).

J. L. Moilliet et al., "Surface Activity", pp. 470, 477 & 478, (1967).

Encyclopedia of Polymer Science & Technology, vol. 6, p. 161, (1967).

McCutcheon's "Detergents and Emulsifiers", pp. 190 & 114–120, (1974).

Anthony M. Schwartz, "Surface Active Agents & Detergents", pp. 163–166, (1958).

*Primary Examiner*—G. L. Kaplan

[57] ABSTRACT

An aqueous, ammonium ion-free acid zinc electroplating solution comprising a source of zinc ion, a soluble electrolyte, boric acid, a non-ionic polyoxyalkylated surfactant, and an organic acid, the bath being operable at a pH of about 3.0 to about 6.5. Preferably, the bath also contains a brightener. Spent baths are simply and inexpensively disposed of.

REEXAMINATION CERTIFICATE ISSUED UNDER 35 U.S.C. 307.

THE PATENT IS HEREBY AMENDED AS INDICATED BELOW.

Matter enclosed in heavy brackets appeared in the patent, but has been deleted and is no longer a part of the patent; matter printed in italics indicates additions made to the patent.

AS A RESULT OF REEXAMINATION, IT HAS BEEN DETERMINED THAT:

Claims 1 and 6 are determined to be patentable as amended:

1. An aqueous ammonium ion-free electroplating bath for depositing zinc comprising about 4.0 to about 100.0 grams per liter of zinc ion, from about 15.0 to about 250.0 grams per liter of an ammoniumfree electrolyte, from about 2.0 to about 40.0 grams per liter of a non-ionic polyoxyalkylated compound selected from the group consisting of alkoxylated alkyl phenols, alkoxylated alkyl naphthols, alkoxylated aliphatic monohydric alcohols, alkoxylated polyoxypropylene glycols, alkoxylated 2,4,7,9-tetramethyl-5-decyne-4,7-diol, alkoxylated ethylene diamine, alkoxylated fatty acids, alkoxylated amides, and alkoxylated esters, from about 0.1 to about 15.0 grams per liter of a carboxylic acid, and at least about 1.0 grams per liter of boric acid or a soluble salt thereof, the pH of said bath being from about 3.0 to about 6.5 *said bath being free from chelating agents capable of complexing with heavy metal ions.*

6. A method for electroplating zinc comprising the steps of:

(a) preparing an ammonium ion-free aqueous bath, *said bath being free from chelating agents capable of complexing with heavy metal ions and* comprising about 4.0 to about 100.0 grams per liter of zinc ion, from about 2.0 to about 40.0 grams per liter of a non-ionic polyoxyalkylated compound selected from the group consisting of alkoxylated alkyl phenols, alkoxylated alkyl naphthols, alkoxylated aliphatic monohydric alcohols alkoxylated polyoxypropylene glycols, alkoxylated 2,4,7,9-tetramethyl-5-decyne-4,7-diol, alkoxylated ethylene diamine, alkoxylated fatty acids, alkoxylated amides and alkoxylated esters, from about 0.1 to about 15.0 grams per liter of a carboxylic acid, and at least about 1.0 gram per liter of boric acid or a soluble sale thereof;

(b) maintaining said bath at a temperature of from about 15° C to about 45° C and a pH of from about 3.0 to about 6.5;

(c) immersing a work piece having a metallic surface and a zinc anode in said bath; and (d) applying a voltage across said work piece and anode to thereby cause deposition of zinc on said metallic surface.

Claims 2–5 and 7, dependent on amended claims, are determined to be patentable.

* * * * *